US009775398B1

(12) United States Patent
Chang

(10) Patent No.: US 9,775,398 B1
(45) Date of Patent: Oct. 3, 2017

(54) DEVICE WHICH FITS OVER A SHOE AND METHOD OF USE

(71) Applicant: Jimmy Hinh Chang, Newton, MA (US)

(72) Inventor: Jimmy Hinh Chang, Newton, MA (US)

( * ) Notice: Subject to any disclaimer, the term of this patent is extended or adjusted under 35 U.S.C. 154(b) by 331 days.

(21) Appl. No.: 14/288,856

(22) Filed: May 28, 2014

(51) Int. Cl.
*A43B 3/26* (2006.01)
*A43B 3/16* (2006.01)
*A43B 3/00* (2006.01)

(52) U.S. Cl.
CPC ..... *A43B 3/163* (2013.01); *A43B 3/0036* (2013.01); *A43B 3/0047* (2013.01); *A43B 3/16* (2013.01)

(58) Field of Classification Search
CPC .. A43B 3/163; A43B 3/16; A43B 3/26; A43B 3/24; A43B 3/0047; A43B 3/244; A43B 13/16; A43B 13/28
USPC .... 36/72 R, 7.1 R, 31, 101, 72 B; 280/11.26
See application file for complete search history.

(56) References Cited

U.S. PATENT DOCUMENTS 183,949 A * 10/1876 Lowenthal ..... A43C 15/06 168/13
1,188,377 A * 6/1916 Weaver ..... A63C 17/02 280/11.204
1,406,033 A * 2/1922 Kingston ..... A43B 13/26 12/142 F
1,606,902 A * 11/1926 Shoemaker ..... A63C 17/22 280/11.26
3,834,377 A * 9/1974 Lebold ..... A43B 3/16 128/DIG. 15
3,993,318 A * 11/1976 Rothmayer ..... A63C 17/0086 280/11.26
4,120,103 A * 10/1978 Colby ..... A43B 3/26 36/130
4,294,025 A * 10/1981 Keller ..... A43B 5/0419 36/132
4,420,894 A * 12/1983 Glassman ..... A43B 13/28 36/107
4,557,060 A * 12/1985 Kawashima ..... A43B 5/00 36/30 R
4,610,100 A * 9/1986 Rhodes ..... A43B 21/39 36/36 A
4,944,099 A * 7/1990 Davis ..... A43B 3/26 36/102
5,025,574 A * 6/1991 Lasher, III ..... A43B 21/40 36/36 R
5,421,596 A * 6/1995 Lee ..... A63C 17/0086 280/11.19
5,836,592 A * 11/1998 Chang ..... A43B 5/1608 280/11.26

(Continued)

*Primary Examiner* — Sharon M Prange
*Assistant Examiner* — Carolyn W Davis
(74) *Attorney, Agent, or Firm* — Ted Masters

(57) ABSTRACT

A device fits over a shoe to prevent contaminants from the shoe from soiling a support surface such as the carpet or floor of a home. The shoe has a toe and a heel. The device includes a front section which is shaped and dimensioned to receive the toe of the shoe, and a rear section which is shaped and dimensioned to receive the heel of the shoe. A center section is used to removably connect the front section to the rear section. The center section is fabricated from a resilient material so that it can be expanded to receive the shoe, and then will resiliently contract to grip the shoe.

12 Claims, 8 Drawing Sheets

(56) References Cited

U.S. PATENT DOCUMENTS

| | | | | |
|---|---|---|---|---|
| 6,044,578 | A * | 4/2000 | Kelz | A43B 3/18 36/117.4 |
| 6,311,416 | B1 * | 11/2001 | Cohen | A43B 7/00 36/115 |
| 7,290,358 | B2 * | 11/2007 | Francis | A43B 5/0419 36/132 |
| 7,500,324 | B1 | 3/2009 | Power et al. | |
| 2004/0221486 | A1 * | 11/2004 | Dennison | A43B 7/18 36/31 |
| 2008/0296871 | A1 * | 12/2008 | Hsieh | A43B 3/26 280/607 |
| 2009/0235556 | A1 * | 9/2009 | Reid | A43B 3/163 36/7.1 R |
| 2010/0257750 | A1 * | 10/2010 | Bell | A43C 15/02 36/7.6 |
| 2011/0258882 | A1 * | 10/2011 | Jones | A43B 5/0419 36/132 |
| 2014/0259777 | A1 * | 9/2014 | Morris Thill | A43B 3/246 36/100 |

* cited by examiner

DEVICE WHICH FITS OVER A SHOE AND METHOD OF USE

CROSS REFERENCE TO RELATED APPLICATION

None

TECHNICAL FIELD

The present invention pertains generally to shoes, and more particularly to a device which fits over a shoe for the purpose of preventing contaminants from the shoe from coming in contact with a support surface.

BACKGROUND OF THE INVENTION

To reduce germ exposure and keep a home floor clean, some people ask guests to remove their shoes before entering their home. However, some quests are not comfortable removing their shoes and therefore will not accept the invitation to enter. In these instances, the homeowner may leave the door open to converse with the guest. This however can be impractical, can cause heating and air conditioning costs to increase, and can allow insects to enter the home.

BRIEF SUMMARY OF THE INVENTION

The present invention is directed to an expandable reusable device which fits over a shoe to prevent contaminants such as dirt, grease, debris and the like from the shoe from soiling a support surface such as the carpet or floor of a home. A guest can put one of the devices on each foot, and then enter a home or other structure without contaminating the support surface. The device completely covers the bottom of the shoe where most contaminants reside. The device is partitioned into three sections; a front section which is shaped and dimensioned to receive the toe of the shoe, a rear section which is shaped and dimensioned to receive the heel of the shoe, and a center section which removably connects the front section to the rear section. The center section is fabricated from a resilient material so that it can be expanded thereby making the device longer to receive the shoe, and then released wherein it contracts so that the device grips the shoe. The device can be manufactured in various sizes to accommodate different shoe sizes. In an embodiment the different sizes are color coded wherein a color indicates a specific shoe size or range of shoe sizes. In another embodiment the device can fit both left and right shoes.

In accordance with an embodiment a device fits over a shoe, the shoe has a toe and a heel. The device includes a front section which is shaped and dimensioned to receive the toe of the shoe, a rear section which is shaped and dimensioned to receive the heel of the shoe, and a center section which is connectable to the front section and to the rear section. The center section includes resilient material, so that when the center section is connected to the front section and to the rear section, a distance between the front section and the rear section can be increased.

In accordance with another embodiment, the device also includes a first connector for connecting the front section to the center section. The first connector includes a first vertically oriented dovetail joint which has a first tenon and a first mortise, wherein the front section has one of the first tenon and the first mortise, and the center section has the other of the first tenon and the first mortise. The device also includes a second connector for connecting the rear section to the center section. The second connector includes a second vertically oriented dovetail joint which has a second tenon and a second mortise. The rear section has one of the second tenon and the second mortise, and the center section has the other of the second tenon and the second mortise.

In accordance with another embodiment, the device includes a third connector for connecting the front section to the center section. The third connector includes a first groove which is shaped and dimensioned to accept a first ridge. The front section has one of the first groove and the first ridge, and the center section has the other of the first groove and the first ridge. The device also includes a fourth connector for connecting the rear section to the center section. The fourth connector includes a second groove which is shaped and dimensioned to accept a second ridge. The rear section has one of the second groove and the second ridge, and the center section has the other of the second groove and the second ridge.

In accordance with another embodiment, the center section has a base and two side walls. The base and side walls are fabricated from the resilient material.

In accordance with another embodiment, the base has a first thickness and the side walls having a second thickness. The first thickness is less than the second thickness.

In accordance with another embodiment, the rear section has a handle for pulling the rear section away from the front section and thereby increasing the distance therebetween.

Other embodiments, in addition to the embodiments enumerated above, will become apparent from the following detailed description, taken in conjunction with the accompanying drawings, which illustrate, by way of example, the principles of the device and method of use.

DETAILED DESCRIPTION OF THE INVENTION

Figure 1:
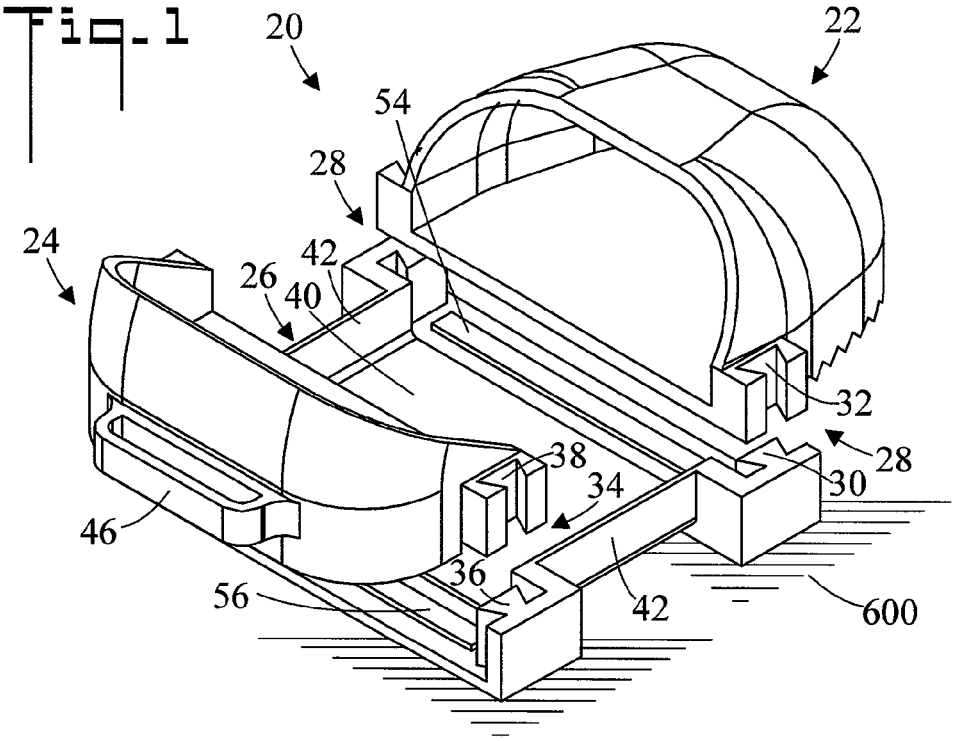
FIG. 1 is a perspective view of a device which fits over a shoe in an unconnected state.
Figure 2:
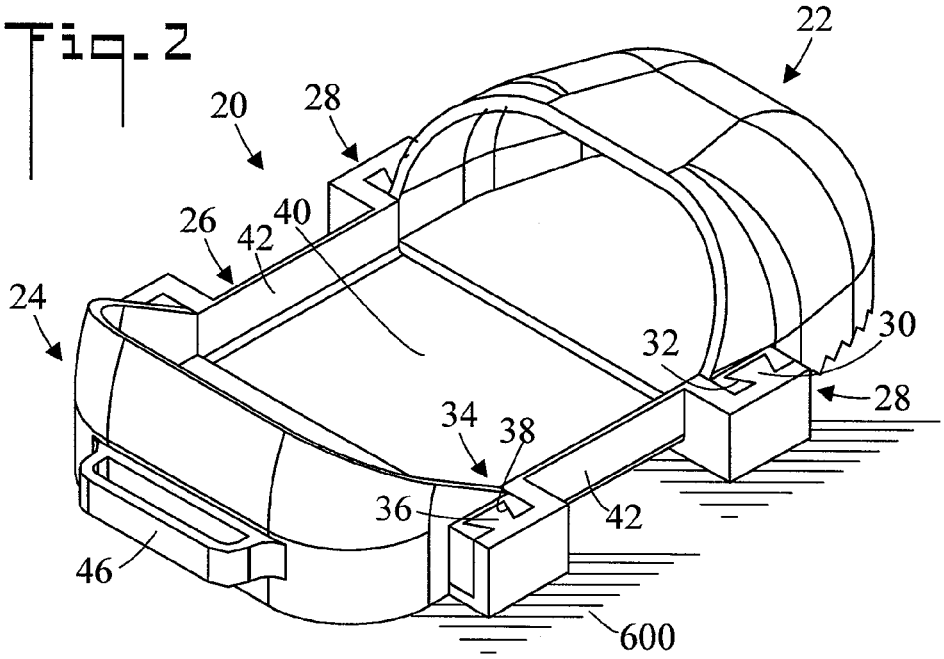
FIG. 2 is a perspective view of the device in a connected state.
Figure 3:
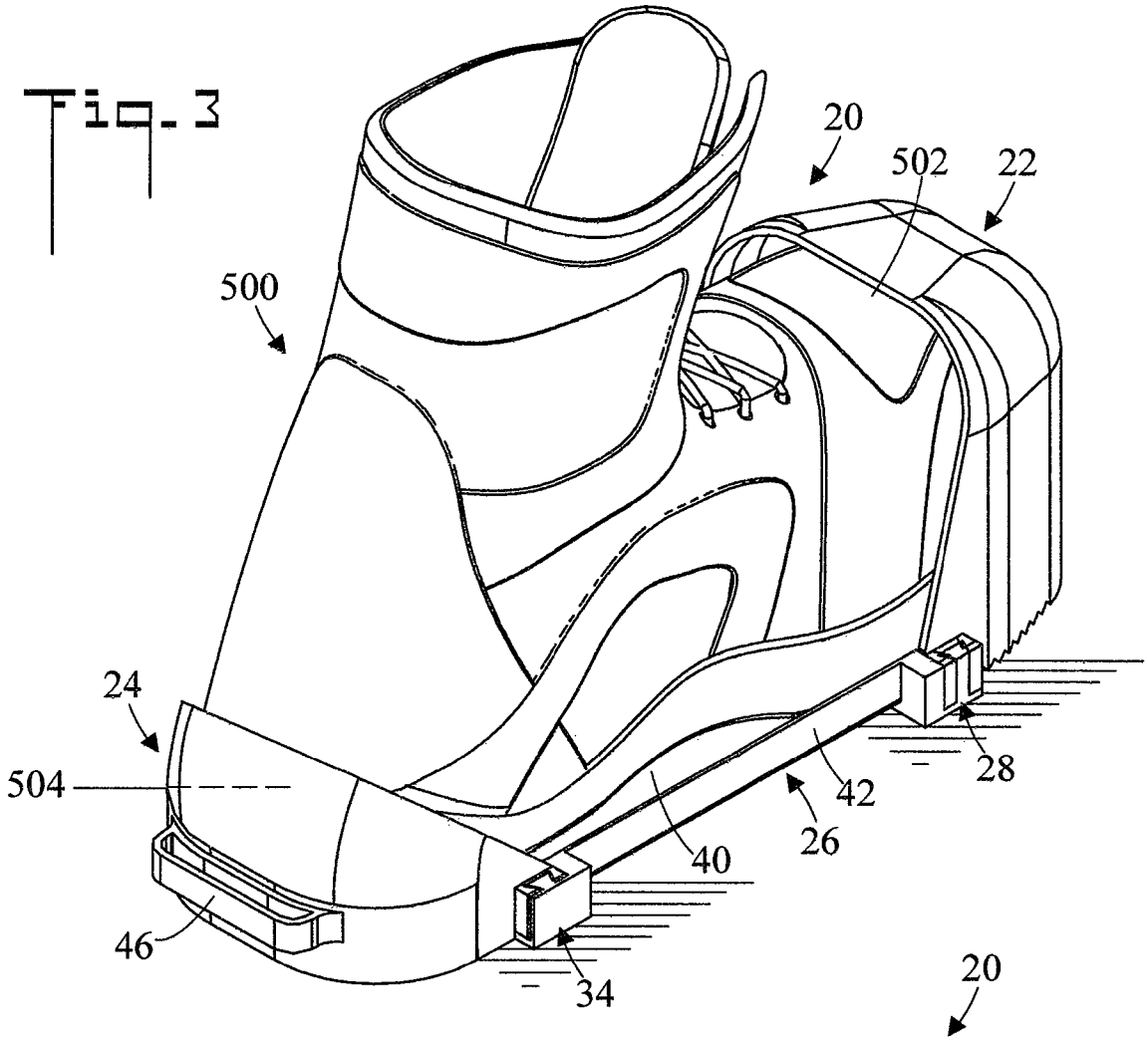
FIG. 3 is a perspective view of the device fitting over a shoe.

Referring initially to FIGS. 1-2, there are illustrated perspective views of a device 20 which fits over a shoe 500 in an unconnected state and in a connected state respectively. FIG. 3 is a perspective view of device 20 fitting over a shoe 500. It may be appreciated that while only one device 20 is shown, in practice two devices 20 will be utilized to fit over both shoes 500 of a user. As used herein the term "fits over a shoe" means that device 20 is shaped and dimensioned to accept shoe 500, and particularly cover the bottom of shoe 500, so that when a user walks shoe 500 will not come in direct contact with a support surface 600 of a home or other structure such as a carpet, wood floors, tile floors, and the like. As such, contaminants 508 from shoe 500 such as dirt, dust, grease, debris, and the like will not be transferred to support surface 600 and soil same (also refer to FIG. 6).

Figure 5:
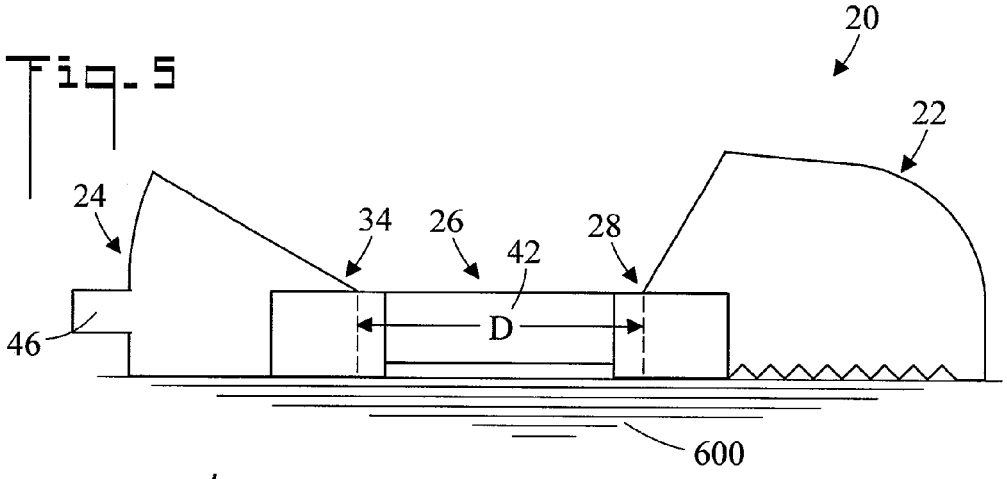
FIG. 5 is a side elevation view of the front section, the rear section, and the center section in the connected state.
Figure 6:
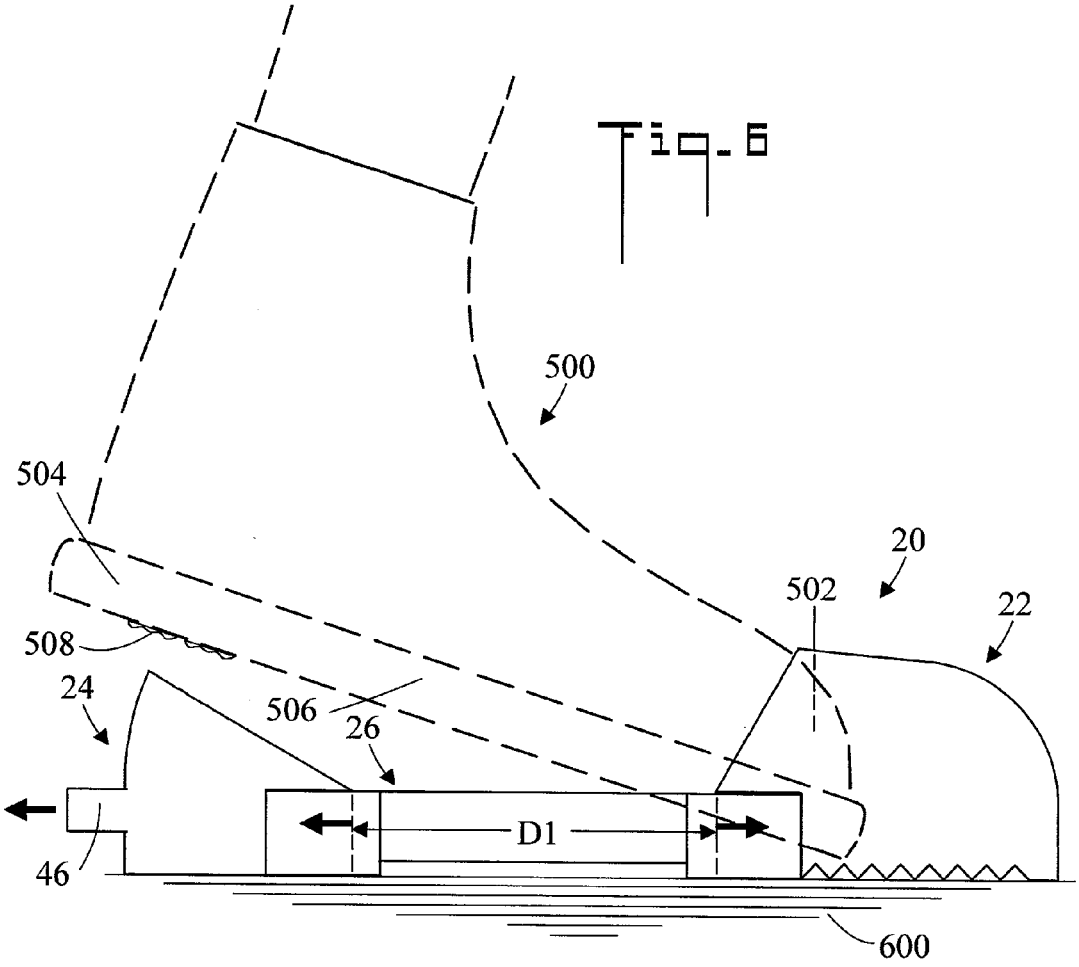
FIG. 6 is a side elevation view of the rear section pulled away from the front section and a shoe being inserted into the device.

Also referring to FIG. 6, shoe 500 has a toe (sometimes called a toe box) 502, heel 504, and a shank 506 therebetween. Device 20 includes a front section 22 which is shaped and dimensioned to receive toe 502 of shoe 500 (also refer to FIG. 7). Device 20 further includes a rear section 24 which is shaped and dimensioned to receive heel 504 of shoe 500. A center section 26 is removably connectable to front section 22 and to rear section 24 so that center section 26 is disposed between front section 22 and rear section 24. Center section 26 includes resilient material, so that when center section 26 is connected to front section 22 and to rear section 24 (as in FIG. 2), a distance D between front section 22 and rear section 24 can be increased (refer also to FIGS. 5 and 6 and the associated discussions). In FIGS. 2 and 3, it is noted that front section 22 and rear section 24 are not directly connected, but are rather indirectly connected by center section 26.

Device 20 includes a first connector for connecting front section 22 to center section 26. In the shown embodiment, the first connector includes a first vertically oriented dovetail joint 28 which has a first tenon 30 and a first mortise 32. Front section 22 has one of first tenon 30 and first mortise 32, and center section 26 has the other of first tenon 30 and first mortise 32. In the shown embodiment, front section 22 has the mortise and center section 26 has the tenon, however this could be reversed. It may be appreciated that device 20 actually has two first connectors 28 disposed on opposite sides of first section 22 and center section 26. The term "vertically oriented" means that the connection or disconnection of tenon 30 and mortise 32 is made vertically such as when center section 26 resides upon support surface 600.

Device 20 also includes a second connector for connecting rear section 24 to center section 26. The second connector includes a second vertically oriented dovetail joint 34 which has a second tenon 36 and a second mortise 38. Rear section 24 has one of second tenon 36 and second mortise 38, and center section 26 has the other of second tenon 36 and second mortise 38. In the shown embodiment, rear section has the mortise and center section has the tenon, however this could be reversed. It may be appreciated that device 20 actually has two second connectors 34 disposed on opposite sides of first section 22 and center section 26. While dovetail joints 28 and 34 are used in the shown embodiment, it may be appreciated that other first and second connection means such as screws, pins, latches, and the like could also be utilized to removably connect front section 22 and rear section 24 to center section 26. Referring to FIGS. 1 and 2, it is noted that front section 22, rear section 24, and center section 26 are each separate sections which are (1) connectable together by a user (FIG. 2), and (2) disconnectable from each other by a user (FIG. 1).

Center section 26 has a base 40 and two side walls 42 (also refer to FIGS. 18-21). Base 40 and side walls 42 are fabricated from a resilient material (such as elastic, rubber, or the like). As such, center section 26 can be stretched along its center axis 44 (refer to FIG. 18) so that shoe 500 can be easily inserted into device 20, and when released return to its original length (refer also to FIG. 6). Rear section 24 has a handle 46 for pulling rear section 24 away from front section 24 and thereby increasing said distance D therebetween (also refer to FIG. 6). Put another way, center section 26 is stretchable so that front section 22 and rear section 24 are movable apart to receive shoe 500. And after shoe 500 is inserted into device 20, center section 26 is contractible so that front section 22 and said rear section 24 grip the shoe 500.

Figure 4:
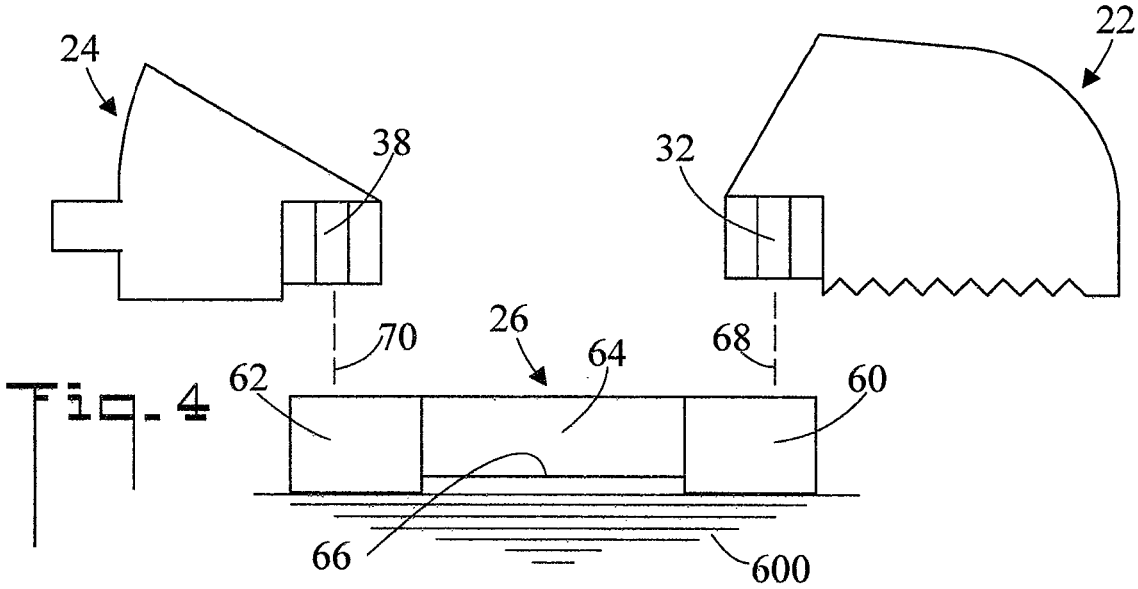
FIG. 4 is a side elevation view of a front section, a rear section, and a center section in the unconnected state.

FIG. 4 is a side elevation view of front section 22, rear section 24, and center section 26 in the unconnected state. Center section 26 is disposed upon support surface 600, with front section 22 and rear section 24 poised above center section ready to be vertically connected. It is noted that center section 26 has a front part 60 which is connectable to front section 22, a rear part 62 which is connectable to rear section 24, and a raised central part 64 disposed between front part 60 and rear part 62, raised central 64 part has a straight lower edge 66 which extends from front part 6Q to rear part 62. When center section 26 is placed upon support surface 600, the raised central part 60 is spaced apart from support surface 600. Center section 26 is positionable upon the support surface 600 so that (1) front part 60 and rear part 62 of center section 26 abut the support surface 600, (2) central part 64 of center section 26 is spaced apart from the support surface 600, and (3) lower edge 66 of central part is parallel to the support surface 600.

It is further noted that the connection of front section 22 to center section 26 by the first connector is made along a first connection axis 68 which is perpendicular to support surface 600, and that the connection of rear section 24 to center section 26 by the second connector is made along a second connection axis 70 which is perpendicular to support surface 600.

FIG. 5 is a side elevation view of front section 22, rear section 24, and center section 26 in the connected state. From the position of FIG. 4, front section 22 and rear section 24 have been moved vertically down to engage both first connector 28 and second connector 34 so that front section 22 and rear section 24 are connected by center section 26. With center section 26 unstretched as shown, a distance D exists between front section 22 and rear section 24. It is noted that front section 22 is designed to directly abut support surface 600, and also that rear section 24 is designed to directly abut support surface 600.

Figure 7:
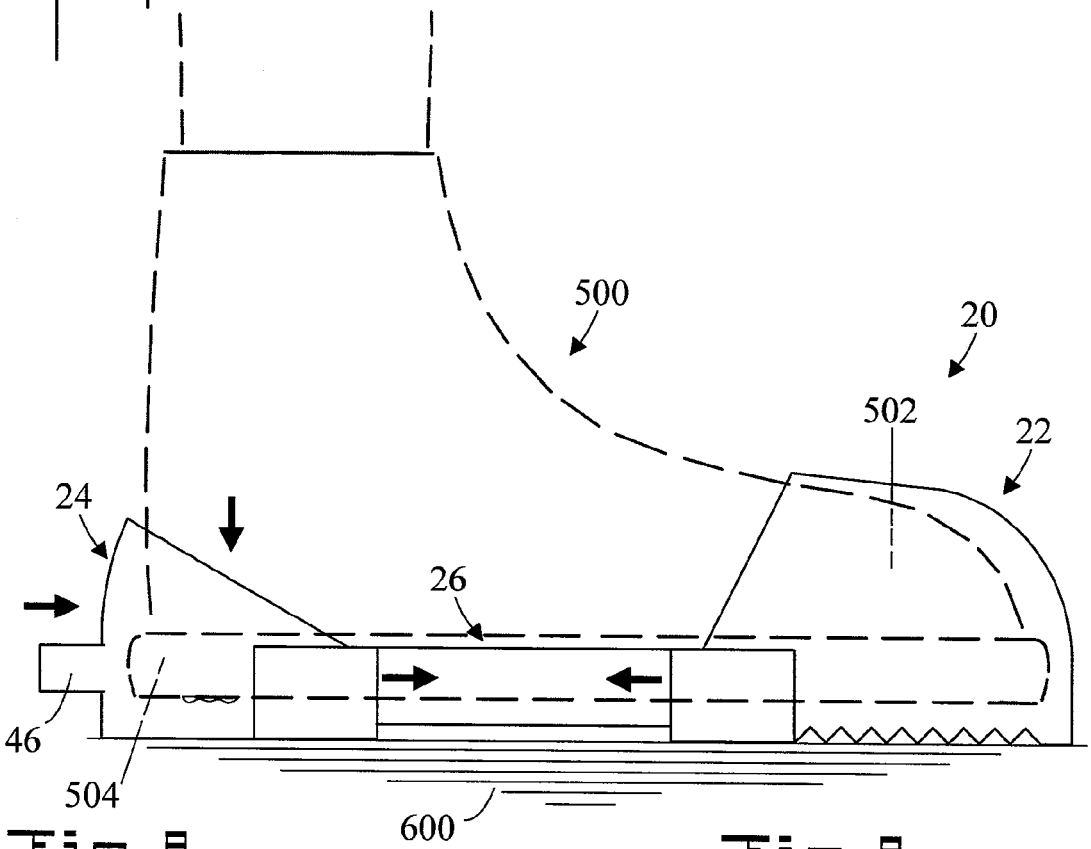
FIG. 7 is a side elevation view of the shoe fully inserted into and firmly gripped by the device.

FIG. 6 is a side elevation view of rear section 24 pulled away from front section 22 and 500 shoe being inserted into device 20, and FIG. 7 is a side elevation view of shoe 500 fully inserted into and elastically gripped by device 20. In FIG. 6, front section 22 and 24 have been connected by center section 26 as in FIG. 5, and reside upon support surface 600. Handle 46 is used to pull rear section 24 away from front section 22 thereby causing distance D between front section 22 and rear section 24 to increase to Dl. Shoe 500 is then inserted into device 20 wherein toe 502 is received by the cavity of front section 22. In FIG. 7, the insertion process continues wherein heel 504 is received by rear section 24. After heel 504 is received by rear section 24, handle 46 is released thereby releasing rear section 24 wherein center section 26 resiliently contracts causing device 20 to grip shoe 500.

Figure 8:
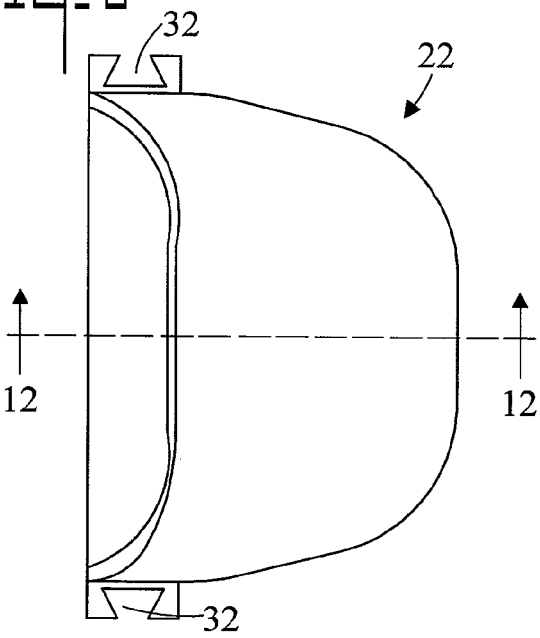
FIG. 8 is a top plan view of the front section.
Figure 9:
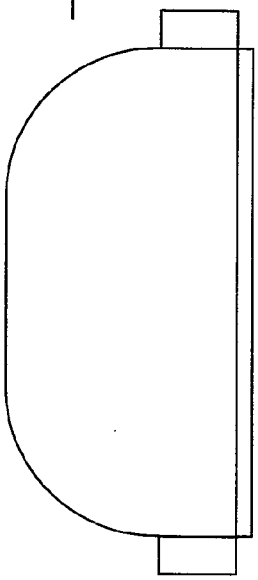
FIG. 9 is a front elevation view of the front section.
Figure 10:
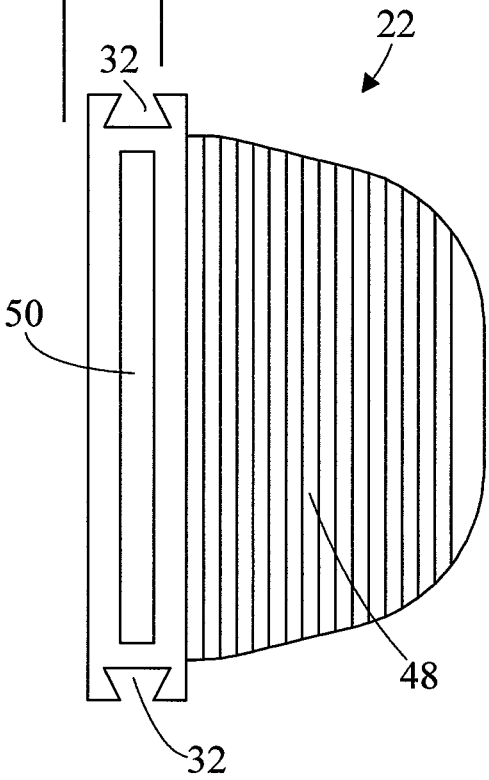
FIG. 10 is a bottom plan view of the front section.
Figure 11:
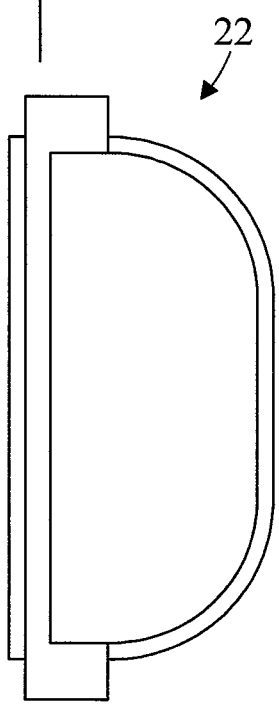
FIG. 11 is a rear elevation view of the front section.
Figure 12:
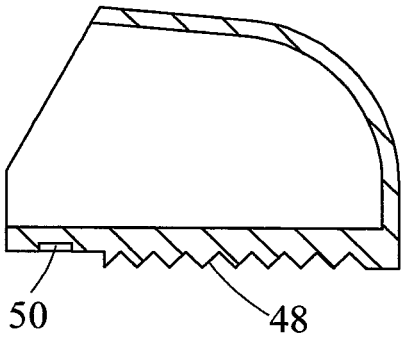
FIG. 12 is a cross sectional view along the line 12-12 of FIG. 8.
Figure 15:
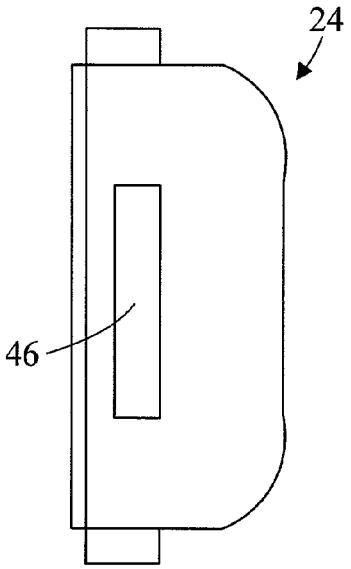
FIG. 15 is a rear elevation view of the rear section.
Figure 13:
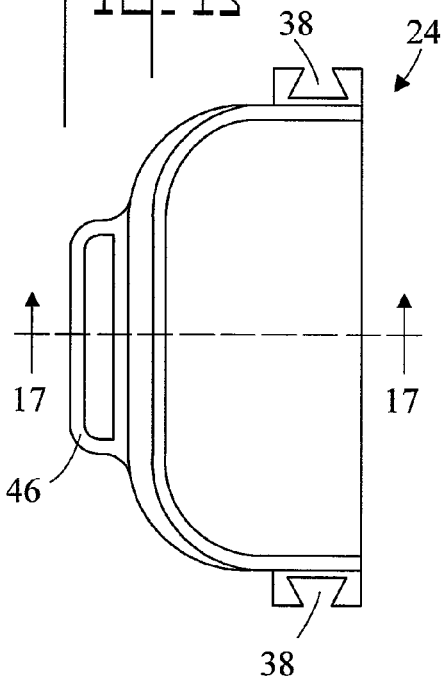
FIG. 13 is a top plan view of the rear section.
Figure 16:
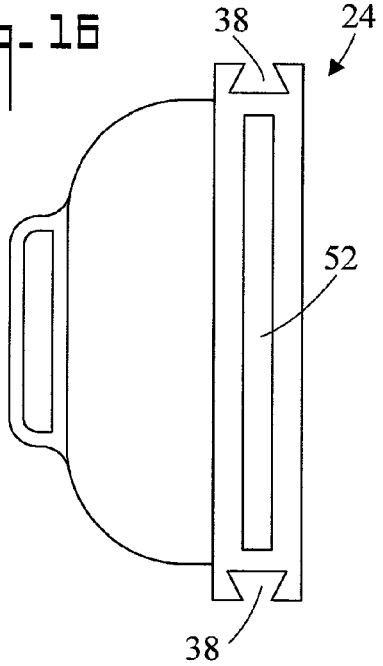
FIG. 16 is a bottom plan view of the rear section.
Figure 14:
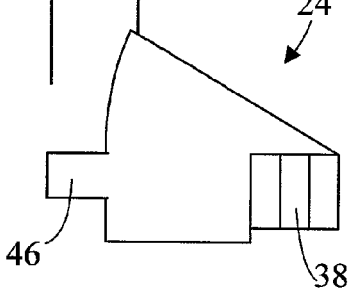
FIG. 14 is a side elevation view of the rear section.

FIGS. 8-11 are top plan, front elevation, bottom plan, and rear elevation view respectively of front section 22, and FIG. 12 is a cross sectional view along line 12-12 of FIG. 8. Shown are mortise 32, and tread 48 which is disposed on the bottom. Also shown is a groove 50 on the bottom of front section 22 which is part of a third connector for connecting front section 22 to center section 26, and which is discussed below.

Figure 17:
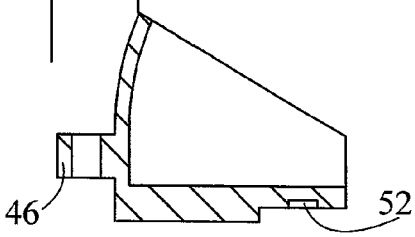
FIG. 17 is a cross sectional view along the line 17-17 of FIG. 13.

FIGS. 13-16 are top plan, side elevation, rear elevation, and bottom plan views respectively of rear section 26. FIG. 17 is a cross sectional view along the line 17-17 of FIG. 13. Shown are mortise 38 and handle 46. Also shown is a groove 52 on the bottom of rear section 24 which is part of a fourth connector for connecting rear second 24 to center section 26, and which is discussed below.

Figure 18:
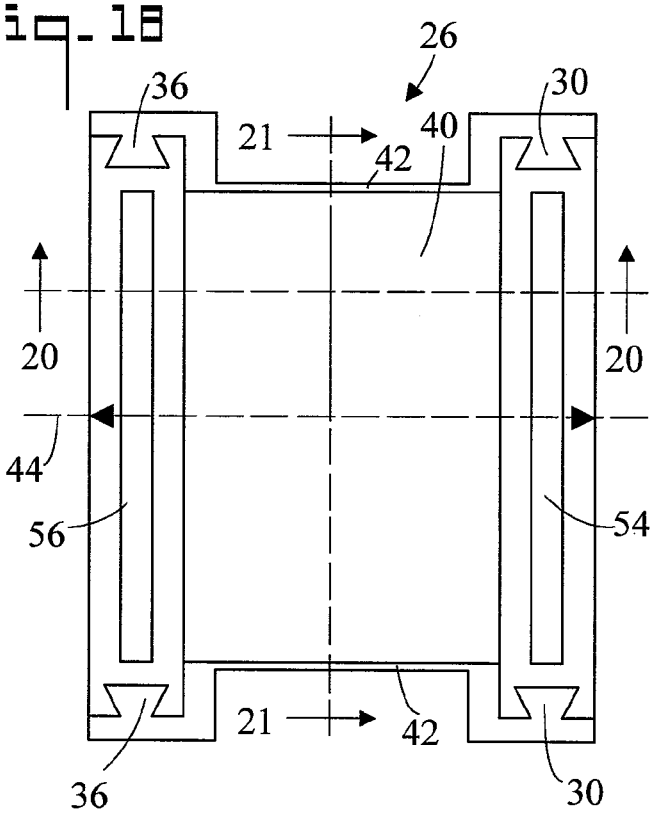
FIG. 18 is a top plan view of the center section.
Figure 21:
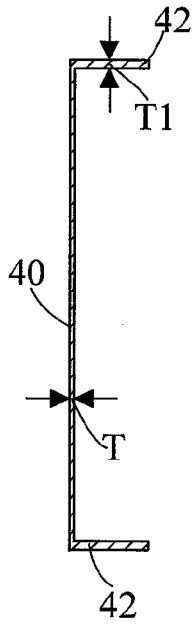
FIG. 21 is a cross sectional view along the line 21-21 of FIG. 18.
Figure 19:
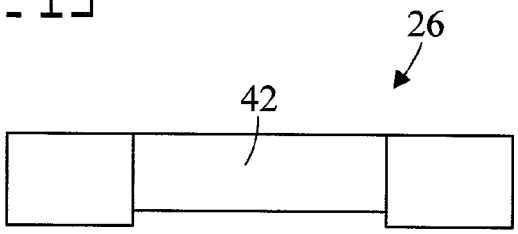
FIG. 19 is a side elevation view of the center section.
Figure 20:
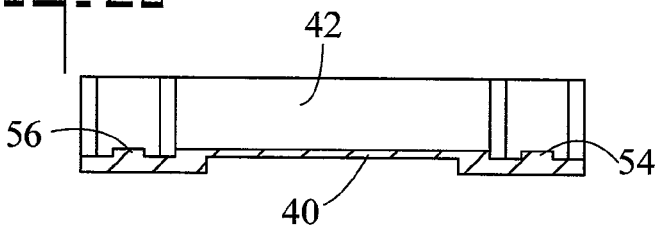
FIG. 20 is a cross sectional view along the line 20-20 of FIG. 18.

FIGS. 18-19 are top plan and side elevation views respectively of center section 26. FIG. 20 is a cross sectional view along the line 20-20 of FIG. 18, and FIG. 21 is a cross section view along the line 21-21 of FIG. 18. Shown are tenon 30, tenon 36, base 40, sides 42, and center axis 44 along which center section 26 resiliently expands. Also shown is first ridge 54 which cooperates with first groove 50 on front section 22, and second ridge 56 which cooperates with second groove on rear section 24. Referring to FIG. 21, base 40 has a first thickness T and two side walls having a second thickness T1. First thickness T is less than second thickness T1. This feature provides more support on the side of device 20.

Referring to FIGS. 1, 10, 12, 18, and 20, a third connector is provided for connecting front section 22 to center section 26. The third connector includes first groove 50 which is shaped and dimensioned to accept first ridge 54. Front section 22 has one of first groove 50 and first ridge 54, and center section 26 has the other of first groove 50 and first ridge 54. In the shown embodiment, front section 22 has the groove and center section 26 has the ridge, however this could be reversed. When front section 22 is connected to center section 26 as in FIGS. 2 and 5, first groove 50 receives first ridge 54 to help hold first section 22 and center section 26 together.

Referring to FIGS. 16, 17, 18, and 20, a fourth connector is provided for connecting rear section 24 to center section 26. The fourth connector includes second groove 52 which is shaped and dimensioned to accept second ridge 56. Rear section 24 has one of second groove 52 and second ridge 56, and center section 26 has the other of second groove 52 and second ridge 56. In the shown embodiment, rear section 24 has the groove and center section 26 has the ridge, however this could be reversed. When rear section 24 is connected to center section 26 as in FIGS. 2 and 5, second groove 52 receives second ridge 56 to help hold rear section 24 and center section 26 together.

Figure 22:
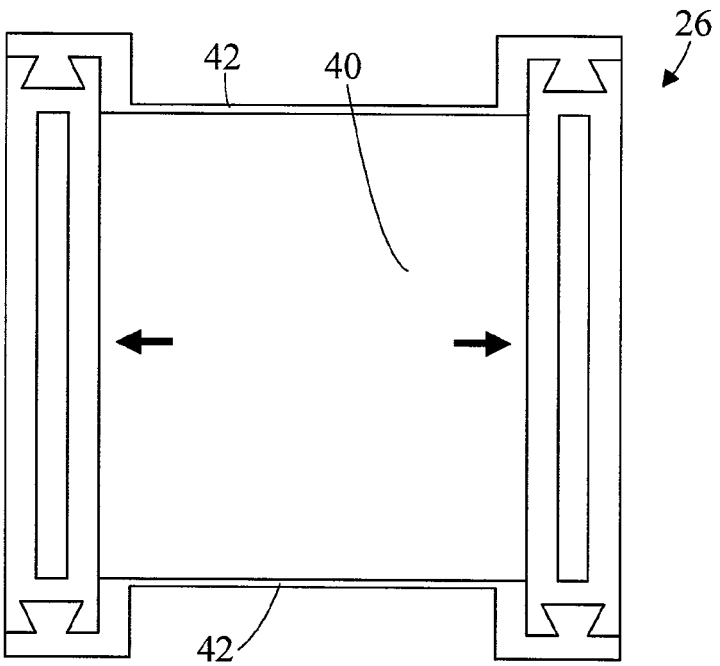
FIG. 22 is a top plan view of the center section being stretched.
Figure 23:
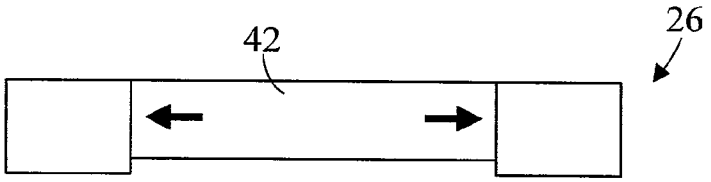
FIG. 23 is a side elevation view of the center section being stretched; and, FIG. 24 is a top plan view of the device in the unexpanded state.

FIGS. 22 and 23 are top plan and side elevation views respectively of center section 26 being stretched, as indicated by the arrows. Base 40 and side walls 42 are fabricated from resilient material.

Figure 24:
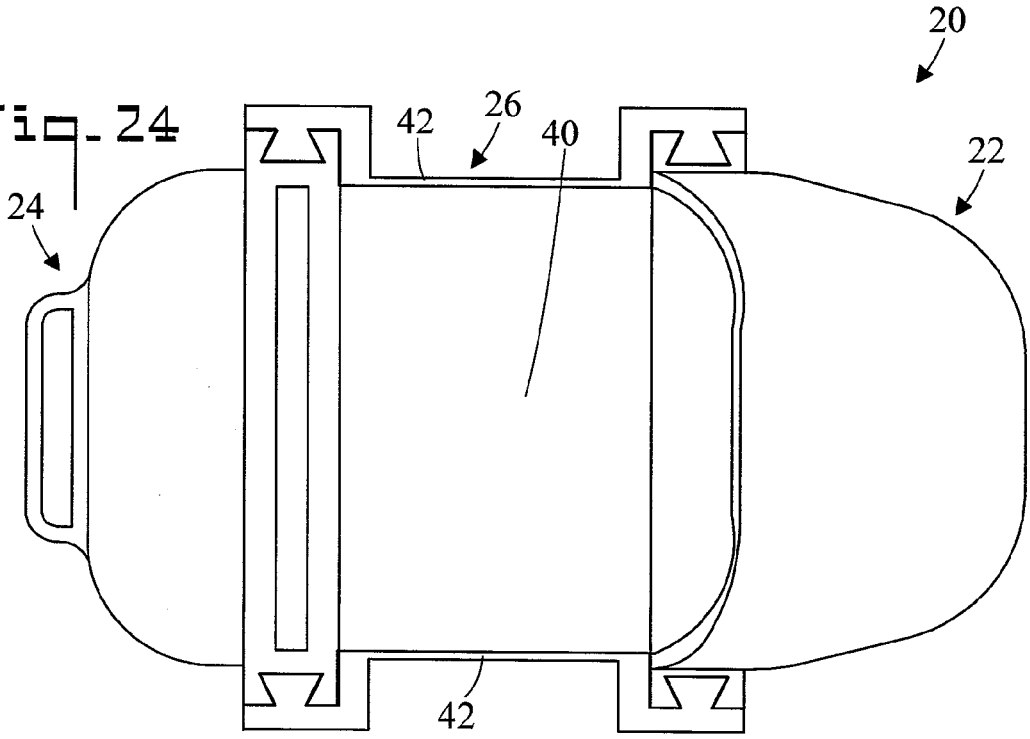

FIG. 24 is a top plan view of device 20 in the unexpanded state showing front section 22, rear section 24, and center section 26 in a relaxed unstreached condition.

In terms of use, a method for preventing soiling of a support surface 600 by contaminants 508 which are disposed on a shoe 500 includes: (refer to FIGS. 1-24)

(a) providing a support surface 600;

(b) providing a shoe 500 upon which contaminants 508 are disposed, shoe 500 having a toe 502 and a heel 504;

(c) providing a device 20 which fits over shoe 500, device 20 including,

- a front section 22 which is shaped and dimensioned to receive toe 502 of shoe 500;
- a rear section 24 which is shaped and dimensioned to receive heel 504 of shoe 500;
- a center section 26 which is connectable to front section 22 and to rear section 24;
- center section 26 including resilient material, so that when center section 26 is connected to front section 22 and to rear section 24, a distance D between front section 22 and rear section 24 can be increased;

(d) connecting center section 26 to front section 22 and to rear section 24;

(e) pulling rear section 24 away from front section 22 thereby causing distance D between front section 22 and rear section 24 to increase;

(f) inserting shoe 500 into device 20 wherein toe 502 is received by front section 22 and heel 504 is received by rear section 24;

(g) releasing rear section 24 wherein center section 26 contracts causing device 20 to grip shoe 500; and, (h) walking upon support surface 600.

The method further including:

in (c), providing a first connector for connecting front section 22 to center section 26, the first connector including a first vertically oriented dovetail joint 28 having a first tenon 30 and a first mortise 32, front section 22 having one of first tenon 30 and first mortise 32, and center section 26 having the other of first tenon 30 and first mortise 32;

in (c), providing a second connector for connecting rear section 24 to center section 26, the second connector including a second vertically oriented dovetail joint 34 having a second tenon 36 and a second mortise 38, rear section 24 having one of second tenon 36 and second mortise 38, and center section 26 having the other of second tenon 36 and second mortise 38;

in (d), connecting first tenon 30 to first mortise 32; and, in (d), connecting second tenon 36 to second mortise 38.

The method further including:

in (c), providing a third connector for connecting front section 22 to center section 26, third connector including a first groove 50 which is shaped and dimensioned to accept a first ridge 54, front section 22 having one of first groove 50 and first ridge 54, and center section 26 having the other of first groove 50 and first ridge 54;

in (c), providing a fourth connector for connecting rear section 24 to center section 26, fourth connector including a second groove 52 which is shaped and dimensioned to accept a second ridge 56, rear section 24 having one of second groove 52 and second ridge 56, and center section 26 having the other of second groove 52 and second ridge 54;

in (d), causing first groove 50 to receive first ridge 54; and, in (d) causing second groove 52 to receive second ridge 56.

The method further including:

before (d), placing center section 26 upon a horizontal support surface 600.

The method further including:

in (c), rear section 24 having a handle 46 for pulling rear section 24 away from front section 22 and thereby increasing distance D therebetween; and, during (e), using handle 46 to pull rear section 24 away from front section 22.

The embodiments of the device and method of use described herein are exemplary and numerous modifications, combinations, variations, and rearrangements can be readily envisioned to achieve an equivalent result, all of which are intended to be embraced within the scope of the appended claims. Further, nothing in the above-provided discussions of the device and method should be construed as limiting the invention to a particular embodiment or combination of embodiments. The scope of the invention is defined by the appended claims.

I claim:

1. A device which fits over a shoe, the shoe having a toe and a heel, the device cooperating with a support surface, the device comprising:

a front section which is shaped and dimensioned to receive the toe of the shoe;

a rear section which is shaped and dimensioned to receive the heel of the shoe;

a center section including resilient stretchable material so that it can expand and contract, said center section having a center axis, and said center section stretchable along said center axis to increase a distance between said front section and said rear section;

said center section is removably connectable to said front section and to said rear section;

said front section designed to directly abut the support surface;

said rear section designed to directly abut the support surface;

a first connector for connecting said front section to said center section;

said first connector including a first dovetail joint having a first tenon and a first mortise, said front section having one of said first tenon and said first mortise, and said center section having the other of said first tenon and said first mortise;

connection of said front section to said center section by said first connector being made along a first connection axis which is perpendicular to the support surface;

a second connector for connecting said rear section to said center section;

said second connector including a second dovetail joint having a second tenon and a second mortise, said rear section having one of said second tenon and said second mortise, and said center section having the other of said second tenon and said second mortise; and connection of said rear section to said center section by said second connector being made along a second connection axis which is perpendicular to the support surface.

2. The device according to claim 1, further including:

a third connector for connecting said front section to said center section;

said third connector including a first groove which is shaped and dimensioned to accept a first ridge, said front section having one of said first groove and said first ridge, and said center section having the other of said first groove and said first ridge;

a fourth connector for connecting said rear section to said center section; and, said fourth connector including a second groove which is shaped and dimensioned to accept a second ridge, said rear section having one of said second groove and said second ridge, and said center section having the other of said second groove and said second ridge.

3. The device according to claim 1, further including:

said center section having a base and two side walls;

said base and side walls being fabricated from said resilient material.

4. The device according to claim 3, further including:

said base having a first thickness and said side walls having a second thickness; and, said first thickness being less than said second thickness.

5. The device according to claim 1, further including:

said rear section having a handle for pulling said rear section away from said front section and thereby increasing said distance therebetween.

6. A method for preventing soiling of a support surface by contaminants which are disposed on a shoe, comprising:

(a) providing a support surface;

(b) providing a shoe upon which contaminants are disposed, said shoe having a toe and a heel;

(c) providing a device which fits over said shoe, said device including, a front section which is shaped and dimensioned to receive said toe of said shoe a rear section which is shaped and dimensioned to receive said heel of said shoe;

a center section including resilient stretchable material so that it can expand and contract, said center section having a center axis, and said center section stretchable along said center axis to increase a distance between said front section and said rear section;

said center section is removably connectable to said front section and to said rear section;

said front section designed to directly abut said support surface;

said rear section designed to directly abut said support surface;

(d) connecting said center section to said front section and to said rear section;

(e) pulling said rear section away from said front section causing said center section to expand and said distance between said front section and said rear section to increase;

(f) inserting said shoe into said device wherein said toe is received by said front section and said heel is received by said rear section;

(g) releasing said rear section wherein said center section contracts causing said device to grip said shoe;

(h) walking upon said support surface;

in (c), providing a first connector for connecting said front section to said center section, said first connector including a first dovetail joint having a first tenon and a first mortise, said front section having one of said first tenon and said first mortise, and said center section having the other of said first tenon and said first mortise, said connection of said front section to said center section made along a first connection axis which is perpendicular to said support surface;

in (c), providing a second connector for connecting said rear section to said center section, said second connector including a second dovetail joint having a second tenon and a second mortise, said rear section having one of said second tenon and said second mortise, and said center section having the other of said second tenon and said second mortise, said connection of said rear section to said center section made along a second connection axis which is perpendicular to said support surface;

in (d), connecting said first tenon to said first mortise; and, in (d), connecting said second tenon to said second mortise.

7. The method of claim 6, further including:

in (c), providing a third connector for connecting said front section to said center section, said third connector including a first groove which is shaped and dimensioned to accept a first ridge, said front section having one of said first groove and said first ridge, and said center section having the other of said first groove and said first ridge;

in (c), providing a fourth connector for connecting said rear section to said center section, said fourth connector including a second groove which is shaped and dimensioned to accept a second ridge, said rear section having one of said second groove and said second ridge, and said center section having the other of said second groove and said second ridge;

in (d), causing said first groove to receive said first ridge; and, in (d), causing said second groove to receive said second ridge.

8. The method of claim 7, further including:

before (d), placing said center section upon a horizontal support surface.

9. The method of claim 6, further including:

in (c), said rear section having a handle for pulling said rear section away from said front section and thereby increasing said distance therebetween; and, during (e), using said handle to pull said rear section away from said front section.

10. The device according to claim 1, further including:

said front section, said rear section, and said center section each being separate sections which are (1) connectable together by a user, and (2) disconnectable from each other by a user.

11. The device according to claim 1, further including:

said center section is stretchable so that said front section and said rear section are movable apart to receive the shoe; and, said center section is contractible so that said front section and said rear section grip the shoe.

12. The device according to claim 1, further including:

said center section having a front part which is connectable to said front section, a rear part which is connectable to said rear section, and a raised central part disposed between said front part and said rear part, said raised central part having a straight lower edge which extends from said front part to said rear part;

said center section positionable upon the support surface so that (1) said front part and said rear part of said center section abut the support surface, (2) said central part of said center section is spaced apart from the support surface, and (3) said lower edge of said central part is parallel to the support surface;

a third connector for connecting said front section to said center section;

said third connector including a first groove which is shaped and dimensioned to accept a first ridge, said front section having one of said first groove and said first ridge, and said center section having the other of said first groove and said first ridge;

a fourth connector for connecting said rear section to said center section; and, said fourth connector including a second groove which is shaped and dimensioned to accept a second ridge, said rear section having one of said second groove and said second ridge, and said center section having the other of said second groove and said second ridge.

* * * * *